US005255401A

United States Patent [19]

Sambrookes et al.

[11] Patent Number: 5,255,401

[45] Date of Patent: Oct. 26, 1993

[54] SHOWER CADDY

[76] Inventors: Samuel R. Sambrookes; Sheryl R. Sambrookes, both of 19603 N. 36th Dr., Glendale, Ariz. 85308

[21] Appl. No.: 414

[22] Filed: Jan. 4, 1993

[51] Int. Cl.[5] ..... A47K 5/02

[52] U.S. Cl. ..... 4/605; 211/113; 206/77.1; D6/525

[58] Field of Search ..... 4/597, 605, 606; 206/77.1; 248/231.6; 211/113, 13, 75, 71, 74, 89; D6/525, 524; D7/616

[56] References Cited

U.S. PATENT DOCUMENTS

| | | | |
|---|---|---|---|
| 3,059,374 | 10/1962 | Bernay | 211/113 |
| 3,591,014 | 7/1971 | Lindgren | 211/71 |
| 4,398,309 | 8/1983 | Simons | 4/605 |
| 4,453,279 | 6/1984 | Logsdon | 4/605 |
| 4,475,660 | 10/1984 | Cain | 211/113 |
| 4,541,131 | 9/1985 | Sussman | 211/113 |
| 4,548,572 | 10/1985 | Hoffman | 206/77.1 |
| 4,573,591 | 3/1986 | Chap | 211/113 |
| 4,681,219 | 7/1987 | Kitchens | 211/74 |
| 4,889,141 | 12/1989 | Lindsey | 206/77.1 |
| 5,044,522 | 9/1991 | Roig et al. | 4/605 |
| 5,065,966 | 11/1991 | Hartke | 211/74 |
| 5,148,926 | 9/1992 | Cocuzzo et al. | D6/525 |

FOREIGN PATENT DOCUMENTS

| | | | |
|---|---|---|---|
| 968761 | 6/1975 | Canada | 211/71 |

*Primary Examiner*—Henry J. Recla
*Assistant Examiner*—Charles R. Eloshway
*Attorney, Agent, or Firm*—Antonio R. Durando; Harry M. Weiss

[57] ABSTRACT

A shower caddy that comprises a bottle holder/drainer that allows a bottle to remain stable in either an upright or inverted position, permitting the easy and convenient use or drainage of the bottle; a soap bar holder that allows wet soap to drain without forming a pool of soap slime under the soap or in the bottom of the holder; and an adjustable mechanism for attachment of the caddy to a shower arms or pipe to achieve a very secure attachment. The caddy further includes accommodations for slender tubular-shaped items like razors and brushes and hanging bars for cloths and towels.

19 Claims, 2 Drawing Sheets

SHOWER CADDY

BACKGROUND OF THE INVENTION

1. Field of the Invention

This invention is related in general to the fields of bath and kitchen utility accessories and, in particular, to a shower caddy unit comprising a bottle holder/-drainer, a soap holder that eliminates soap slime collection and a mechanism for securely attaching the unit to an anchor such as a pipe or shower arm.

2. Description of the Prior Art

Caddies are popular objects used to store and organize various accessories found and used in bathrooms, kitchens, craft rooms, garages or any other areas where a method of maintaining order among sundry small items is required. Caddies characteristically comprise compartments, slots, nooks, crannies and other defined spaces designed to accommodate items of a variety of shapes and sizes.

Some caddies are portable units that rest on a supporting surface such as a counter or shelf and can be moved for use in multiple areas. For additional convenience, such caddies are often mounted on swivel bases. Other caddies are designed to be hung in or near the place where the items in them are used, such as the shower caddy found suspended from the shower arm in many bathrooms.

Typically, caddies are constructed of a rigid, lightweight material such as plastic; consist of flat panels configured to form the various components; contain cut-out holes and slots to accommodate items; and may have holes in the bottom for drainage. Other caddies, especially those for bathrooms, are constructed of rigid, wire-like segments, covered with a protective material such as plastic to shield against the effects of moisture and shaped to form shelves, compartments and slots where the stored items are placed.

Caddies used in the bathroom are typically configured to hang on the shower arm by means of an extension or opening at the top whereby the unit is slipped onto the shower arm in a hanging position. This method of attachment is inherently unstable since it allows the unit to slide down the shower arm and, when bumped or knocked, to fall off the arm completely. Another method of hanging involves a hook formed as a half-circle having approximately the same diameter as the shower arm so that the hook will snap onto and mold itself around the shower arm. Since the hook grips the arm or pipe onto which it is hung, the attachment is slightly more secure than the first method described; however, the hook will easily unsnap when bumped or knocked, often breaking because of lack of elasticity and pliability. In addition, if the weight of the items placed on a caddy thus hung is not evenly distributed, the caddy will tend to hang in a lopsided position, often causing the items to fall off. Some caddies provide suction cups facing the shower wall to prevent the uneven distribution of the weight from causing the caddy to assume such lopsided position, but the cups rarely function well because of the grout grooves between tiles. The present invention alleviates the aforedescribed problems of slipping, sliding and lopsidedness by providing a hanging mechanism that can be adjusted to fit a shower arm to achieve a very secure attachment.

Shower caddies are generally constructed with one or more tiers or shelves onto which various bath accoutrements are placed. An item often placed on such shelves is bar soap even though caddies usually lack specialized compartments therefor. A solid panel shelf with drainage holes cut into it or a shelf constructed of wire segments both allow wet soaps placed on them to drain; but a bar of wet soap placed directly on a shelf is messy and is difficult to manipulate and control. Putting the soap in a dish or container before placing it on the shelf may alleviate messy shelf and soap control problems; but, in addition to requiring that additional container, a user must also contend with that notorious pool of soap slime that accumulates in the bottom of the soap dish. The present invention solves these problems by providing a defined area for a soap bar, allowing adequate drainage of the soap and eliminating the soap slime pool.

Shower caddies are convenient repositories for bottles containing shampoo, hair conditioner, bath gel and other related items of toiletry. When full, a bottle usually remains in its upright position unless jarred or hit. As the bottle approaches empty, however, it becomes lighter and less stable; if jarred, even slightly, it will fall to the floor of the tub or shower, which is hard enough to cause even the sturdiest plastic bottle to crack, spewing its contents down the drain. The problem is compounded because users typically turn near-empty bottles upside down to increase the ease of removing what remains and to ensure that the last drop is indeed dislodged. The dual challenge, of course, is keeping the bottle standing on its head and preventing it from falling to the floor of the tub or shower. The present invention solves these problems by providing means for a bottle to remain in a stable, inverted position that permits easy and convenient use of the bottle or allows the cap of the bottle to be removed, if desired, enabling all contents to flow from the bottle into the hand or into a separate open container.

BRIEF SUMMARY OF THE INVENTION

One objective of this invention is a shower caddy that includes a bottle holder/drainer which allows bottles of various sizes to remain stable in either upright or inverted positions, thus permitting the easy and convenient use and drainage of the bottles.

Another objective of this invention is a shower caddy that includes a soap bar holder that allows wet soap to drain without forming a pool of soap slime under the soap or in the bottom of the holder.

A further objective of the invention is mechanism that can be adjusted to fit a shower arm to achieve a very secure attachment.

Another goal is a caddy comprising accommodations for slender tubular-shaped items like razors and brushes and hanging bars for cloths and towels.

A final objective is the easy and economical manufacture of the invention according to the above stated criteria. This is achieved by using commercially available components and materials, modified only to the extent necessary to fit the requirements of the invention.

Therefore, according to these and other objectives, the present invention consists of a shower caddy that comprises a bottle holder/drainer that allows bottles of various sizes to remain stable in either upright or inverted positions, permitting the easy and convenient use or drainage of the bottles; a soap bar holder that allows wet soap to drain without forming a pool of soap slime under the soap or in the bottom of the holder; and an adjustable mechanism for attachment of the caddy to a shower arm or pipe to achieve a very secure attachment. The caddy further includes accommodations for slender tubular-shaped items like razors and brushes and hanging bars for cloths and towels.

Various other purposes and advantages of the invention will become clear from its description in the specifications that follow and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

This invention lies in a shower caddy that comprises a bottle drainer, a soap-bar holder and an adjustable mechanism that allows the unit to be securely hung from a shower arm or other pipe. The caddy is constructed to enable the addition of accommodations for slender tubular-shaped items like razors and brushes and a hanging bar for a cloth or towel.

Figures 1, 1A:
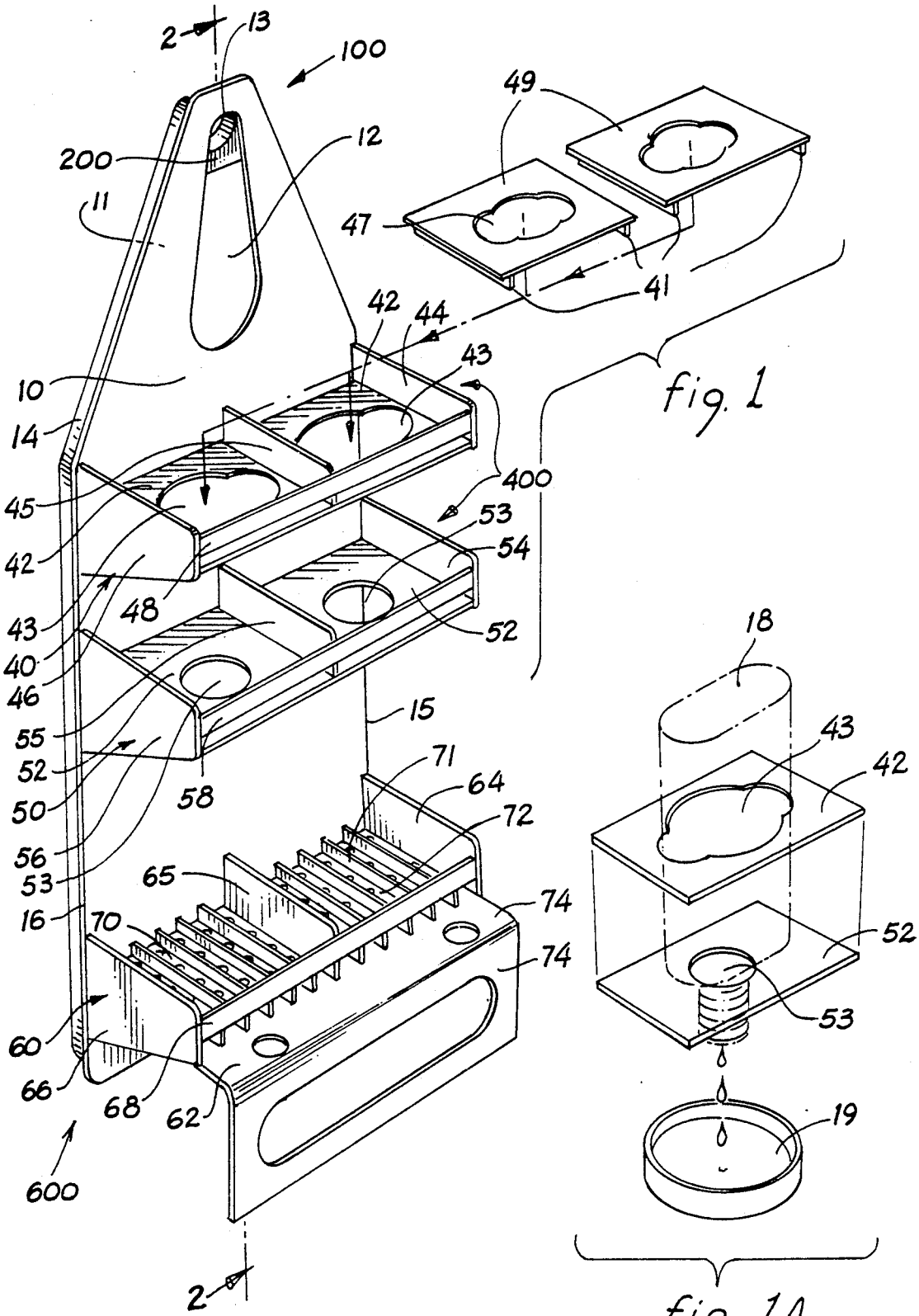
FIG. 1 is a perspective view of the shower caddy of the invention wherein two bottle-plate inserts of the bottle holder/drainer are shown in a removed position.
FIG. 1A is a perspective view of the bottle plate and neck plate components of the bottle holder/drainer of the invention illustrating a bottle being drained into an open container.

Referring to the drawings, wherein like parts are designated throughout with like numerals and symbols, FIG. 1 illustrates in perspective view the preferred embodiment of the shower caddy unit 100. The caddy comprises a flat panel 10 with a head opening 12 cut out at the upper end. Attached to the backside 11 of the panel at the upper end or crown 13 of the head opening 12 is an adjustable hanger mechanism 200, illustrated in FIG. 3 and partially visible in FIG. 1 and FIG. 2, which comprises an upper grip 22, a lower grip 24, a left rod 36, a right rod 38, a left nut 37 and a right nut 39. The grips 22 and 24 are rectangular blocks, which in the preferred embodiment are approximately 4.5 cm wide, 1.5 cm thick and 2.3 cm high and have an upper arch 23 cut out of the center of the bottom of the upper grip 22 and a lower arch 25 cut out of the center of the top of the lower grip 24. The arches 23 and 25 must be sufficiently broad to accommodate the widest of the typical pipes or arms to which shower heads are attached, as one skilled in the art would know. In the preferred embodiment, these arches have a radius of approximately 1 cm, which will allow a snug fit around the standard half-inch pipe used for most shower arms. In addition, the upper arch 23 and the crown 13 of the head opening 12 (seen if FIG. 1) have like curvatures. The arches could also be constructed with a larger radius to accommodate larger pipes; the addition of an element such as a rubber-strip lining covering the arch would allow a snug fit also around the smaller half-inch pipe.

The upper grip 22 is placed on the backside 11 of the panel 10 with the upper arch 23 and the crown 13 aligned and is then permanently attached thereto by a means such as gluing or screwing. So long as the crown 13 fits congruently with the upper arch 23 as described, the head opening 12 may be of any general shape and size that allows the pass-through of a shower arm and a non-removable shower head of normal and customary size, as one skilled in the field would know. In the preferred embodiment, the opening 12 is teardrop-shaped, so that a shower head may be passed through its larger lower portion and kept from being released by the narrower dimension of its upper portion (the crown 13); the lower portion is about 8 cm wide and the crown is about 2.2 cm wide.

Figure 3:
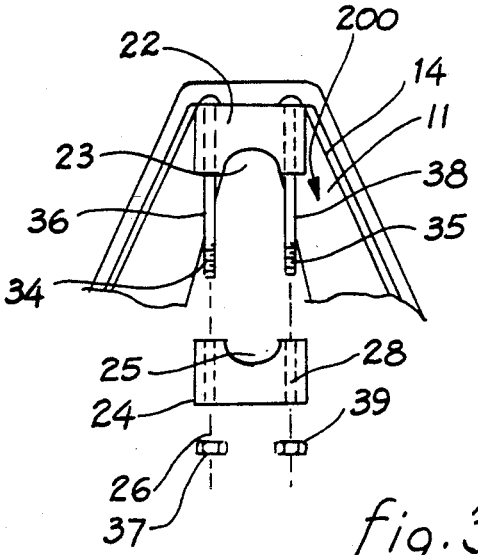
FIG. 3 is a partial elevational view of the hanging mechanism of the caddy as seen from line 3—3 in FIG. 2.

As seen in FIG. 3, fixedly inserted through vertical channels in of the upper arch 23 are the left rod 36 and the right rod 38, each having a tubular shape and a threaded end 34 and 35, respectively. Extending through the height of the lower grip 24 on both sides of the lower arch 25 are a left channel 26 and a right channel 28, which are sized and positioned so that the left rod 36 fits slidably into the left channel 26 and the right rod 38 fits slidably into the right channel 28. Each rod 36 and 38 is long enough so that when the caddy 100 is positioned for hanging and each rod is inserted into its respective channel 26 and 28, each will extend through the lower grip 24 with its threaded end 34 and 35 protruding therefrom. Removably attached to the threaded ends 34 and 35 of the left rod 36 and the right rod 38 are the left nut 37 and the right nut 39, respectively. Each nut is threaded for coupling with the threaded end of its respective rod. In the preferred embodiment, the rod protruding from the upper grip is about 5 cm long.

To hang the caddy 100 onto a shower arm protruding from a wall and adjust the hanger mechanism 200 to achieve a secure attachment, a user first removes the left and right nuts 37 and 39 and the lower grip 24 from the rods 36 and 38 and then passes the shower head and arm through the bottom portion of the head opening 12, so that the hanger mechanism 200 is placed between the panel 10 and the wall from which the shower arm protrudes. The caddy is positioned so that it hangs by the upper arch 23 on the shower arm. The lower grip 24 with left rod 36 inserted into the left channel 26 and the right rod 38 inserted into the right channel 28 is then slided upward until the lower arch 25 pushes against the shower arm. At that point, the left nut 37 is screwed onto the threaded end 34 of the left rod 36 and the right nut 39 is screwed onto the threaded end 35 of the right rod 38 to lock the grips 22 and 24 firmly around the shower arm.

Figure 2:
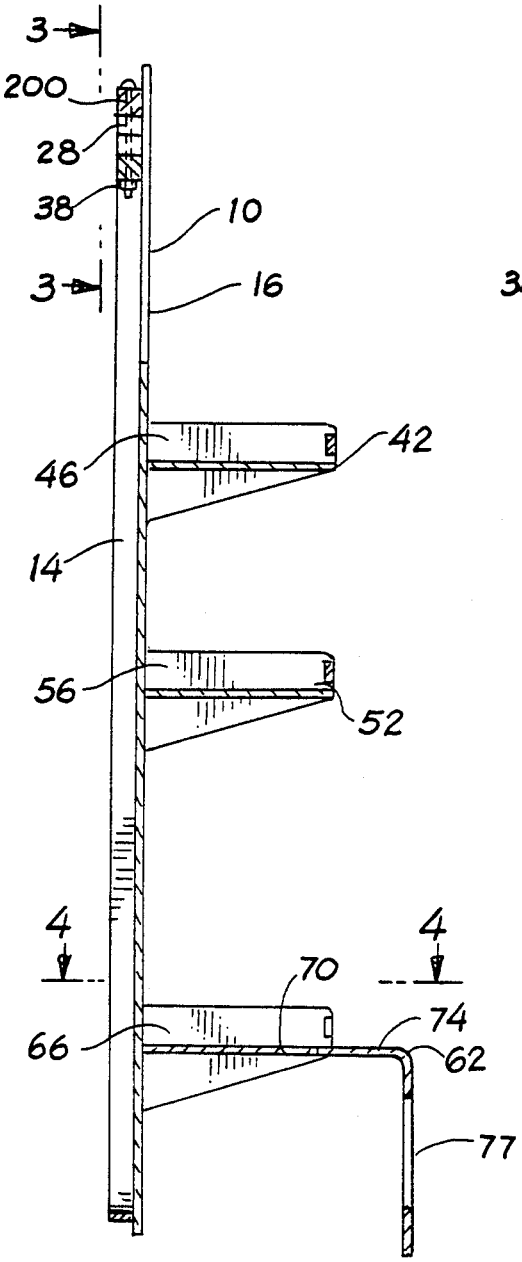
FIG. 2 is a cross-sectional view of the caddy taken from line 2—2 in FIG. 1.

As seen in the preferred embodiment of FIG. 1, FIG. 2 and FIG. 3, a reinforcing rim 14 preferably having a depth equal to the thickness of the grips 22 and 24 extends around the perimeter of the backside 11 of the panel 10. The rim provides a structural encasement for the hanger mechanism 200 and helps maintain the caddy 100 in a stable vertical position as it hangs from the shower arm because it forms a uniform surface along the backside of the panel for contact with the abutting wall. Obviously, these purposes can be achieved with a rim that runs around only part of the perimeter, and absence of a rim will not hinder the overall functionality of the invention. In order to achieve the desired purposes, however, the rim must be at least as deep as the depth of the grips.

As illustrated in FIG. 1, attached to the panel 10 is a bottle drainer 400, which comprises an upper plate-holder 40, a lower plate-holder 50, a bottle plate 42, a bottle-plate insert 49 and a neck plate 52. The holders 40 and 50 consists of upper and lower left-side brackets 44 and 54, respectively, attached perpendicularly to the left edge 15 of the panel; upper and lower right-side brackets 46 and 56, respectively, attached perpendicularly to the right edge 16 of the panel; and upper and lower front brackets 48 and 58, respectively, attached to the front edges of their respective side brackets. The upper plate-holder 40 accommodates the bottle plate 42 and the bottle-plate insert 49, which is removable. The lower plate-holder 50 accommodates the neck plate. The bottle-plate insert 49 has a ridge 41 running in parallel along at least two opposite underside edges of the insert. When the bottle-plate insert 49 is placed on the bottle plate 42, the ridges prevent the two surfaces from making contact and forming a moisture seal. This provide ventilation to dry moisture that accumulates between the bottle plates 42 and insert 49 and also allows easy removal of the insert.

For increased stability and weight-bearing, the side brackets 44, 54, 46, 56 preferably have a trapezoidal shape with an upper edge substantially perpendicular to the panel 10 and the longer of the two parallel sides flush with the panel 10, as illustrated in FIG. 1 and FIG. 2. In the preferred embodiment, the side brackets are 10.5 cm wide and 6.4 and 3.0 cm high at the longer and shorter edges, respectively. Each of the front brackets 48 and 58 consists of a rectangular bar attached to the front edge of the respective side brackets 44, 46, 54, 56.

In the preferred embodiment illustrated in FIG.1, the panel 10 is wide enough for the drainer 400 to accommodate two adjacent bottles. Added to the upper and lower plate-holders 40 and 50 are an upper center bracket 45 and a lower center bracket 55, respectively, which are the same shape and size as the upper and lower left-side and right-side brackets 44, 54, 46, 56 and which function as the right side bracket for one plate and the left side bracket for the adjacent plate. In addition, a brace (not visible in the drawings) is attached to the panel 10 and to the underside of the plates 42 and 52 for increased strength and support. Obviously, the panel 10 may be constructed narrower so as to accommodate only one bottle drainer 400 or wider so as to accommodate more than two bottle drainers. Since the adjustable hanging mechanism provides a snug and secure attachment of the caddy to a shower arm, even bottles of different sizes and weights may be accommodated in adjacent bottle drainers without the caddy becoming lopsided.

The method of attaching the side and center brackets to the panel and to the front brackets and of attaching the bottle plate and the neck plate to the panel and to the brackets may be any means that accomplishes the connection, such as gluing or welding, or by providing interlocking slots. The panel, the various brackets, the bottle plate and the neck plate may also be constructed as a single unit, such as by plastic molding.

Figure 5:
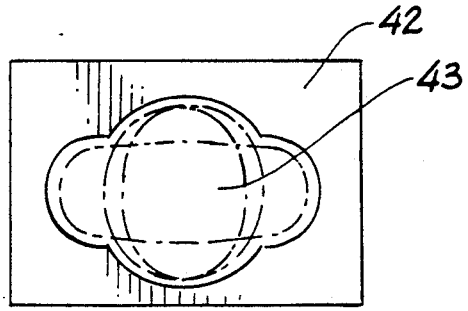
FIG. 5 is a top plan view of the bottle plate of the bottle holder/drainer illustrating the position of variously shaped bottle in broken line.

Important features of the invention are bottle openings 43 and 47 that are cut into the bottle plate 42 and the bottle-plate insert 49, respectively, to accommodate the body of a bottle being drained. The openings must be able to receive and retain in a substantially vertical position various shapes of bottles. In the preferred embodiment, as illustrated in FIG. 1, FIG. 1A and FIG. 5, this is achieved by shaping the bottle openings 43 and 47 as a circle superimposed over a substantially elliptical aperture, with the circle and ellipse opening 43 of the bottle plate 42 being coaxial with the circle and ellipse opening 47 of the bottle-plate insert 49. Thus, openings so shaped will accommodate a variety of bottles having substantially elliptical (oval) cross-sections as well as round ones, as shown by the broken lines in FIG. 5. The size of the circle-ellipse cut-outs must be large enough to accommodate typical bath and shower product bottles, as one familiar with such products would know. The opening 47 of the bottle-plate insert 49 is sized to provide snug accommodations for smaller bottles, while the opening 43 of the bottle plate 42 is similarly shaped but sized for larger bottles. To accommodate larger bottles, the bottle-plate insert 49 is removed allowing the larger bottles to fit into opening 43 of the bottle plate 42. To accommodate most shampoo and soap bottles currently on the market, it is found that the larger opening 43 of the bottle plate 42 should be a circle with an approximate radius of 4.65 cm superimposed over an ellipse having a major axis and a minor axis of about 12 and 7.3 cm, respectively, and the smaller opening 47 of the bottle-plate insert 49 should be a circle with an approximate radius of 3.35 cm superimposed over an ellipse having major and minor axes of about 9 and 5.3 cm, respectively.

In the neck plate 52, a circular neck opening 53 is cut to accommodate the neck of a bottle, as shown in FIG. 1 and FIG. 1A. The opening must be large enough to allow entry of the necks of typical bath and shower product bottles but too small to allow entry of the bodies of such bottles, as one familiar with such products would know. It is found that a circular opening having a radius of about 2.75 cm is suitable for most shampoo and soap bottles currently on the market.

The distance between the two plates 42 and 52 must be such that when a bottle is inverted with its neck placed in the neck opening 53, the body of the bottle will be within the bottle opening 43, thereby enabling the bottle to remain stable in the inverted position. The distance between the two plates 42 and 52 should be no less than is necessary to allow the upper body plate 42 to support the shortest of typical bath and shower product bottles when they are inverted, as one familiar with the products would know. A greater distance will prevent the height of short bottles from reaching the bottle opening; a shorter distance will result in so much of a bottle extending above the bottle plate 42 that stability is decreased. A distance in the 8 to 11 cm range is recommended.

By positioning the bottle neck in the neck opening 53 and the bottle in the bottle opening 43, the upper and lower plates 42 and 52 support the inverted bottle and allow it to remain stable even if the bottle is knocked or jarred. The inverted bottle may be closed, thereby allowing the contents, especially of near-empty bottles, to collect near the cap and be more accessible when the cap is removed. Or an inverted bottle 18 may be open, thereby allowing the bottle contents to drain into an open container 19 positioned thereunder, as illustrated in FIG. 1A. In addition, the bottle drainer 400 may be used to hold upright bottles. Since the neck opening 53 is smaller than the body of the bottle, the neck plate 53 will serve as a shelf or table for an upright bottle placed on it, and the bottle body will fit into the bottle opening 43, thereby preventing the upright bottle from falling even when knocked or jarred.

It should be further noted that even bottles with bodies larger than the bottle opening 43 may be accommodated if bottle plate 42 is also constructed so as to be removable, rather than as an integral part of the upper plate-holder 40. In that case, when bottle plate 42 is removed from the upper plate holder 40 and the bottle, either upright or inverted, is placed on the lower neck plate 52, the bottle will be supported and contained, not by the perimeter of the bottle opening 43, but rather by the boundary formed by the panel 10, upper left- and right-side brackets and upper front bracket 48.

Also attached to the panel 10 is a soap-bar holder 600, which comprises a drainer plate holder 60 and a drainer plate 70. The drainer plate holder 60 consists of a left-side drainer bracket 64 attached to the left edge 15 of the panel 10, a right-side drainer bracket 66 attached to the right edge 16 of the panel and a front drainer bracket 68 attached to the two side drainer brackets. In the preferred embodiment, the drainer brackets are identical in form, function and method of attachment as the corresponding upper and lower left-side and right-side brackets 44, 54, 46, 56 of the bottle drainer 400, as described above. Therefore, a center drainer bracket 65 corresponds to the upper and lower center brackets, 45 and 55 respectively, of the bottle drainer.

Figure 4:
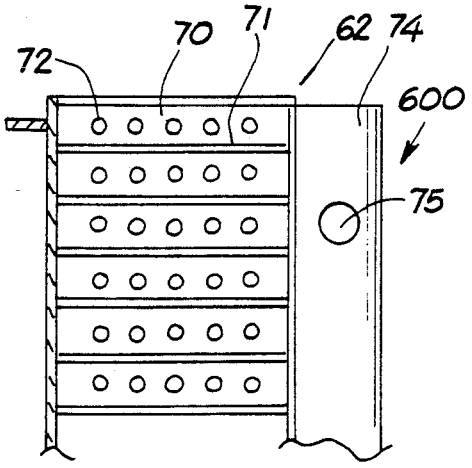
FIG. 4 is a top plan view of the soap holder in the caddy as seen from line 4—4 in FIG. 2.

In the preferred embodiment, as illustrated in FIG. 1 and FIG. 4, the drainer plate 70 comprises alternating parallel rows of holes 72 and thin, horizontal rails 71 that stand perpendicular to the drainer plate. The rails support the wet bar of soap a user places on them, allowing water to flow off the soap and drain through the holes 72. This combination of holes and rails prevents semi-liquid accumulations, commonly known as soap slime, from forming under the soap. The rails must be thin enough to minimize contact with the soap, thus eliminating a gathering place for soap slime. The rails must be tall enough to prevent a bar of soap placed on them from coming into contact with the plate 70; but, in order to prevent the soap from sliding out of the holder, the rails should not be taller than the brackets 64, 66, 68 surrounding the drainer plate 70. In a fashion equivalent to the function of the rails 71, the soap bar may be held elevated above the drainer plate 70 by any means that achieves that end such as spikes, bumps, comb-like teeth or other rises. Likewise, the holes may be openings of any shape and of any size that allow the flow-through of soap slime. In the preferred embodiment, the drainer plate contains five rails and six parallel rows of five holes each, as seen in FIG. 4. More or fewer rails are acceptable, however, so long as the number of rails is sufficient to provide a stable resting place for a soap bar and the rails are close enough to prevent small bars from lodging between them. Likewise, any number of holes sufficient to allow drainage as described is acceptable.

Either in addition to or integral with the drainer plate 70, an L-shaped plate 62 may be provided for additional accessory functions. The plate 62 may consist of a utility shelf 74, forming the leg of the L perpendicular to the panel 10, and a towel hanger 77, forming the leg hanging downward parallel to the panel, as seen in FIG. 1. In the preferred embodiment, two circular utility holes 75 are cut into the shelf 74 to accommodate tubular-shaped items such as razors or brushes. The remainder of the shelf will accommodate small bath items such as a sponge, comb or piece of pumice. Into the towel hanger 77 is cut a towel opening 78, which consists of an aperture sufficiently large to accommodate the hanging of an item such as a washcloth.

In the preferred embodiment, seen in FIG. 1, the panel 10 of the caddy consists of a rectangular lower section to which the bottle drainer 400 and soap bar holder 600 are attached and a triangular upper section containing the head opening 12 and hanger mechanism 200. However, any shape that accommodates the desired configuration of bottle drainers and soap-bar holders is acceptable to practice the invention. In the preferred embodiment illustrated, a panel approximately 60 cm high and 26 cm wide accommodates two side-by-side bottle drainers and two side-by-side soap holders.

The upper front brackets 48, lower front brackets 58 and front drainer brackets 68 are obviously the same width as the panel 10. In the preferred embodiment, they are 1.3 cm high and are constructed and positioned to allow maximum ventilation above and below the respective plates 42, 52 and 62 to which they are attached. In addition, lower front bracket 58 will act as a barrier that prevents an upright bottle sitting on the neck plate 52 from slipping off, and the front drainer bracket 68 will act as a barrier to keep a soap bar from slipping off the rails 71.

Optimally and as a practical matter, the caddy should be constructed of a material that can successfully withstand regular contact with water, moisture and chemicals used in bath and shower products. In addition, the material must be rigid enough to maintain the shape of the unit and its various parts and strong enough to support the weight of the items that would foreseeably be placed on it. Any commercially available material such as plastic, fiberglass, acrylic and stainless steel, or another material coated with a water-resistant layer that meets these criteria, would be acceptable.

While the embodiment shown in the figures features the specific characteristics and shapes therein described, the invention can obviously take other shapes with equivalent functionality and utility. In fact, any shape for any of the components that retains the functional characteristics described above provides an acceptable apparatus to practice the invention.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

What we claim as our invention is:

1. A shower caddy for hanging on a shower arm having a shower head attached thereto, comprising:

(a) a panel;

(b) a hanger mechanism connected to said panel and adapted to engage said shower arm; and (c) a bottle drainer connected to said panel;

wherein said panel includes an opening sufficiently large to allow the pass-through of a shower head; and wherein said bottle drainer includes an upper portion containing means for holding the body of at least one bottle and a lower portion containing corresponding means for holding the neck of at least one bottle; said upper portion comprising at least one bottle opening consisting of the superimposition of multiple geometrical shapes, so that said opening is able accommodate in a substantially vertical inverted position bottles of various cross-sectional geometries.

2. The shower caddy recited in claim 1, further comprising:

(d) a soap-bar holder connected to said panel and including a drainer plate comprising a multiplicity of holes and means for preventing the formation of soap slime.

3. The shower caddy recited in claim 2, wherein said means for preventing the information of soap slime consists of thin, horizontal rails that stand perpendicularly onto said drainer plate.

4. The shower caddy recited in claim 1, wherein said hanger mechanism consists of an upper grip and a lower grip that adjustably slide together to fit firmly around the shower arm.

5. The shower caddy recited in claim 4, wherein each of said grips consists of a rectangular block containing an arch, said arches being positioned so that they grip the shower arm when the blocks are slided together.

6. The shower caddy recited in claim 5, wherein said upper grip includes two rods fixedly connected thereto and protruding downward therefrom; wherein said lower grip includes two vertical channels aligned with said rods, so that the rods fit slidably therein and protrude downward through said lower grip; wherein each of said rods has a threaded end; and wherein a threaded nut is threadably mated to each said threaded end.

7. The shower caddy recited in claim 6, wherein said arches have a radius of approximately 1 cm.

8. The shower caddy recited in claim 1, wherein said opening in the panel is teardrop-shaped, comprising a narrower upper end and a larger lower end.

9. The shower caddy recited in claim 1, wherein said upper portion of the bottle drainer comprises an upper plate-holder having two upper side brackets attached perpendicularly to said panel and an upper front bracket attached to said upper side brackets.

10. The shower caddy recited in claim 1, wherein said at least one bottle opening consists of a circle superimposed over a substantially elliptical aperture.

11. The shower caddy recited in claim 10, wherein said circle has a radius of approximately 4.65 cm and said substantially elliptical aperture has a major axis of approximately 12 cm and a minor axis of about 7.3 cm.

12. The shower caddy recited in claim 11, further comprising a removable bottle-plate insert corresponding to each of said at least one bottle opening, said removable plate consisting of a plate having an upper side and a lower side and containing an opening comprising a circle with a radius of approximately 3.35 cm superimposed over a substantially elliptical aperture with a major axis of approximately 9 cm and a minor axis of about 5.3 cm, said circle and substantially elliptical aperture being coaxial with the circle and substantially elliptical aperture in said at least one bottle opening.

13. The shower caddy recited in claim 12, further comprising two parallel ridges running along a lower portion of the bottle-plate insert.

14. The shower caddy recited in claim 1, wherein said lower portion of the bottle drainer comprises a lower plate-holder having two lower side brackets attached perpendicularly to said panel and a lower front bracket attached to said lower side brackets; a neck plate connected to said panel and said side brackets, said neck plate having at least one neck opening sized to receive and retain the neck of a bottle when said bottle is accommodated in said at least one bottle opening.

15. The shower caddy recited in claim 14, wherein said at least one neck opening consists of a circle having a radius of about 2.75 cm.

16. The shower caddy recited in claim 1, further comprising a utility shelf integral with said drainer plate.

17. The shower caddy recited in claim 16, wherein said utility shelf contains at least one circular utility hole for accommodating tubular-shaped items.

18. The shower caddy recited in claim 16, wherein said utility shelf is L-shaped and further comprises a towel hanger.

19. The shower caddy recited in claim 1, further comprising:

a soap-bar holder, including a drainer plate, connected to said panel;

a utility shelf integral with said drainer plate containing at least one circular utility hole for accommodating tubular-shaped items;

a towel hanger integrally formed in said shelf; and a removable bottle-plate insert corresponding to each of said at least one bottle opening;

wherein drainer plate comprises a multiplicity of holes and means for preventing the formation of soap slime;

wherein said hanger mechanism consists of an upper grip and a lower grip that adjustably slide together to engage said shower arm;

wherein each of said grips consists of a rectangular block containing an arch with a radius of approximately 1 cm, said arches being positioned so that they grip the shower arm when the blocks are slided together; said upper grip includes two rods fixedly connected thereto and protruding downward therefrom, said lower grip including two vertical channels aligned with said rods, so that the rods fit slidably therein and protrude downward through said lower grip; and wherein each of said rods has a threaded end which is threadably mated with a threaded nut;

wherein said upper portion of the bottle drainer comprises an upper plate-holder having two upper side brackets attached perpendicularly to said panel and an upper front bracket attached to said upper side brackets; a bottle plate connected to said panel and said side brackets, said bottle plate having at least one bottle opening shaped like a circle with a radius of approximately 4.65 cm superimposed over an ellipse with a major axis of approximately 12 cm and a minor axis of about 7.3 cm, so that said opening is able to accommodate bottles of various cross-sectional geometries in a substantially vertical position;

wherein said lower portion of the bottle drainer comprises a lower plate-holder having two lower side brackets attached perpendicularly to said panel and a lower front bracket attached to said lower side brackets; a neck plate connected to said panel and said side brackets, said neck plate having at least one neck opening consisting of a circle having a radius of about 2.75 cm;

wherein said means for preventing the formation of soap slime consists of thin, horizontal rails that stand perpendicular to said drainer plate; and wherein said removable bottle-plate insert consists plate having an upper side and a lower side and containing an opening comprising a circle with a radius of approximately 3.35 cm superimposed over an ellipse with a major axis of approximately 9 cm and a minor axis of about 5.3 cm, said circle and ellipse being coaxial with the circle and ellipse in said at least one bottle opening.

* * * * *